United States Patent [19]

Nakayama et al.

[11] 4,406,715

[45] Sep. 27, 1983

[54] PROCESS FOR PRODUCING GRAIN-ORIENTED ELECTROMAGNETIC STEEL STRIP

[75] Inventors: Tadashi Nakayama; Tsutomu Haratani; Fumio Matsumoto; Hiromi Matsumoto, all of Kitakyushu, Japan

[73] Assignee: Nippon Steel Corporation, Tokyo, Japan

[21] Appl. No.: 256,198

[22] Filed: Apr. 21, 1981

[30] Foreign Application Priority Data

Apr. 26, 1980 [JP] Japan ..... 55-55773

[51] Int. Cl.[3] ..... H01F 1/04

[52] U.S. Cl. ..... 148/111; 148/120; 148/12 A

[58] Field of Search ..... 148/110, 111, 112, 113, 148/12 A, 120, 121

[56] References Cited

U.S. PATENT DOCUMENTS

| | | | |
|---|---|---|---|
| 1,313,054 | 8/1919 | Berry | 148/12 A |
| 1,896,061 | 2/1933 | Otte | 148/111 |
| 2,234,968 | 3/1941 | Hayes et al. | 148/120 |
| 3,647,575 | 3/1972 | Fiedler et al. | 148/111 |
| 3,764,406 | 10/1973 | Littmann | 148/110 |
| 3,990,923 | 11/1976 | Takashina et al. | 148/112 |
| 4,108,694 | 8/1978 | Shiozaki et al. | 148/110 |
| 4,339,287 | 7/1982 | Matsumoto et al. | 148/111 |

FOREIGN PATENT DOCUMENTS 19289 11/1980 European Pat. Off. .

*Primary Examiner*—John P. Sheehan

*Attorney, Agent, or Firm*—Kenyon & Kenyon

[57] ABSTRACT

In a process for the production of a grain-oriented electromagnetic steel strip, a slab is heated, hot-rolled, cold-rolled, and subjected to a decarburization annealing and secondary recrystallization annealing steps. Grain coarsening is likely to occur during the high temperature heating and remain in the final product as streaks. The secondary recrystallization is, therefore, incomplete due to the streaks. In order to remove this disadvantage, the work piece is subjected to at least two rolling passes, wherein the high circumferential speed roll of one pair of the rolls and the low circumferential speed roll of another pair of the rolls are arranged on the same side of the work piece.

4 Claims, 5 Drawing Figures

PROCESS FOR PRODUCING GRAIN-ORIENTED ELECTROMAGNETIC STEEL STRIP

The present invention relates to a process for producing a grain-oriented silicon steel strip or sheet, wherein the crystals of the steel strip or sheet have an orientation of {110} <001> and, further, the steel is easily magnetized in the rolling direction.

As is well known, in the production of a grain-oriented silicon steel strip or sheet, a silicon steel slab is hot rolled and is subjected to at least one cold rolling operation so as to reduce the thickness of the strip. At least one annealing operation is applied to the hot rolled strip or cold rolled strip, if necessary. The steel strip is then subjected to a decarburization annealing and a final high temperature annealing. In the final high temperature annealing, crystal grains of the steel strip or sheet are caused to coarsely grow, so that the crystal grains have a {110} <001> orientation. Such crystal grain growth is referred to as a secondary recrystallization.

As is well known, inhibitors, such as MnS and AlN, play an important role in the inhibition of the growth of matrix grains and in obtaining excellent properties in the rolling direction. It is crucial in the production of grain-oriented silicon steel strips or sheets to effectively control the solid-solution and precipitation of the inhibitor mentioned above. In order to perform such effective control, steel slabs are heated prior to hot rolling to a high temperature, for example 1300° C. or higher, so as to bring the components of the inhibitors, such as Al, N, Mn and S, satisfactorily into a solid solution, and; subsequently, the inhibitors are precipitated in the succeeding steps including the hot rolling. Since the slab heating temperature for a grain-oriented silicon steel is considerably higher than that of the low carbon steel grades, a coarsening of crystal grains is likely to occur during the heating.

Coarse crystal grains having a <110> orientation, which is parallel to the rolling direction, are elongated during the hot rolling in the rolling direction and remain in the hot rolled steel sheet as so called streaks. The elongated crystal grains may not be satisfactorily broken up in the production steps subsequent to the hot rolling, with the result that the secondary recrystallization in the final high temperature annealing becomes incomplete. Portions of the grain-oriented silicon steel strip or sheet, where the secondary recrystallization is incomplete, have the streaks mentioned above. When the slab heating temperature is lower than 1300° C., the inhibitors are not brought into solid solution satisfactorily, and therefore, the secondary recrystallization becomes incomplete, and fine grains appear on the entire surface of the strip or sheet.

In recent years, the conventional ingot making process has been replaced by the continuous casting process, in which a columnar structure is formed in the slab due to rapid cooling solidification, i.e. a peculiar solidification in continuous casting. When slabs having the columnar structure are heated to a high temperature, an abnormal coarsening of the grains is likely to occur, as compared with the slabs produced by the conventional ingot-making and slabbing processes, due to the columnar structure formation. Consequently, the streaks described hereinabove are caused to be formed due to the coarsening of grains.

Fumio Matsumoto and the other four inventors proposed in Japanese Patent Application No. 60057/1979 a process for producing a grain-oriented electromagnetic steel, wherein the steel slab is subjected at a hot rolling step to a plastic flow which is asymmetric in the upper and lower regions of the steel slab as seen in the cross section of the steel slab in the rolling direction, and due to the asymmetric plastic flow, the grain-oriented silicon steel strip with excellent magnetic properties can be produced while utilizing the industrial advantage of the continuous casting process over the conventional ingot-making process, i.e. the elimination of a slabbing step, and simultaneously eliminating the inconvenience of the streak formation and thus stabilizing the secondary recrystallization.

U.S. Pat. No. 1,898,061 discloses a method of forming in a non-oriented steel strip an asymmetric plastic flow which is asymmetric in the upper and lower regions of the strip, thereby improving the watt loss property. However, in the process of U.S. Pat. No. 1,898,061, a strip, for example of 0.4 mm thick strip, which is rolled by a conventional hot rolling method, is folded and the resultant laminate made of a plurality of the folded sections is again rolled, which rolling has been referred to as pack rolling. Subsequently, the rolled products are reheated to a temperature in the range of from 1500° to 1600° F. (815° to 871° C.) and then subjected to an asymmetric rolling at this temperature range by a pair or pairs of rollers having unequal effective surface speeds. Further, a straightening rolling and finally an annealing at 1550° F. (843° C.) are carried out, and the production of an electromagnetic steel is completed. The electromagnetic steel existing at the time of issuance of U.S. Pat. No. 1,898,061 was only the hot rolled non-oriented steel, i.e. so called hot rolled silicon steel sheet, and was used mainly for the core of an electric motor. Although the hot rolled silicon steel sheet was also used for the members of a transformer, its performance is not comparable to that achieved by use of the modern grain-oriented electromagnetic steel sheet.

An important point of U.S. Pat. No. 1,898,061 to be realized in its comparison with the production of a grain-oriented electromagnetic steel is that of the reheating to 815°~871° C. followed by the hot rolling. If a grain-oriented electromagnetic steel is reheated and then rolled, as disclosed in this patent, the precipitation, cohesion and coarsening phenomena of the inhibitor element(s), such as Al, N, Mn and S, which are indispensible for the development of the secondary recrystallization, occur during the reheating. The resultant coarse precipitates cannot be converted to a desirable form by the asymmetric rolling, and they do not provide a grain-growth inhibitor function effective for the generation of the secondary recrystallization, with the result that the secondarily recrystallized grains or Goss texture indispensible for the grain-oriented electromagnetic steel cannot be appreciably formed.

The process proposed in the Japanese patent application No. 60057/1979 fulfills the requirements for producing a grain-oriented electromagnetic steel and involves the basic teaching of how the hot rolling with unequal roll-circumferential speeds can be applied to the production of this steel. Although the final product without streaks and hence with excellent magnetic properties, is produced by this process using a continuously cast slab, the present inventors recognized the necessity of further improving the magnetic properties. Namely, the watt loss value of $W_{17/50}=1.06$ W/kg can be attained by the process of Japanese Patent Application No. 60057/1979, in which at least one rolling with unequal roll-circumferential speed is carried out at a temperature of from 1250° to 950° C., thereby generating an asymmetric plastic flow as seen in the upper region and the lower region of the slab. However, a lower watt loss than 1.06 W/kg is desirably obtained by developing the concept of the hot rolling with the unequal roll-circumferential speeds.

It is an object of the present invention to provide a practical rolling method with unequal roll-circumferential speeds and to reduce the watt loss of a grain-oriented electromagnetic steel so that it is lower than the watt loss achieved by the method previously proposed by Fumio Matsumoto and the other four inventors.

In accordance with the object of the present invention, there is provided a process for producing a grain-oriented electromagnetic steel strip, wherein a steel slab is hot rolled, cold rolled, decarburization-annealed and recrystallization-annealed, characterized in that in the hot rolling step, the rolling with unequal roll-circumferential speeds is carried out in the temperature range of from 950° to 1200° C. by at least one pair of upper and lower work rolls having circumferential speeds different from each other, i.e. by at least one pair of a high circumferential speed roll and a low circumferential speed roll, and further the work piece is subjected to at least two rolling passes, wherein said high circumferential speed work roll and said low work circumferential speed roll are arranged on the same side of the work piece.

The present invention is explained in detail with reference to the drawings, wherein.

Figure 1:
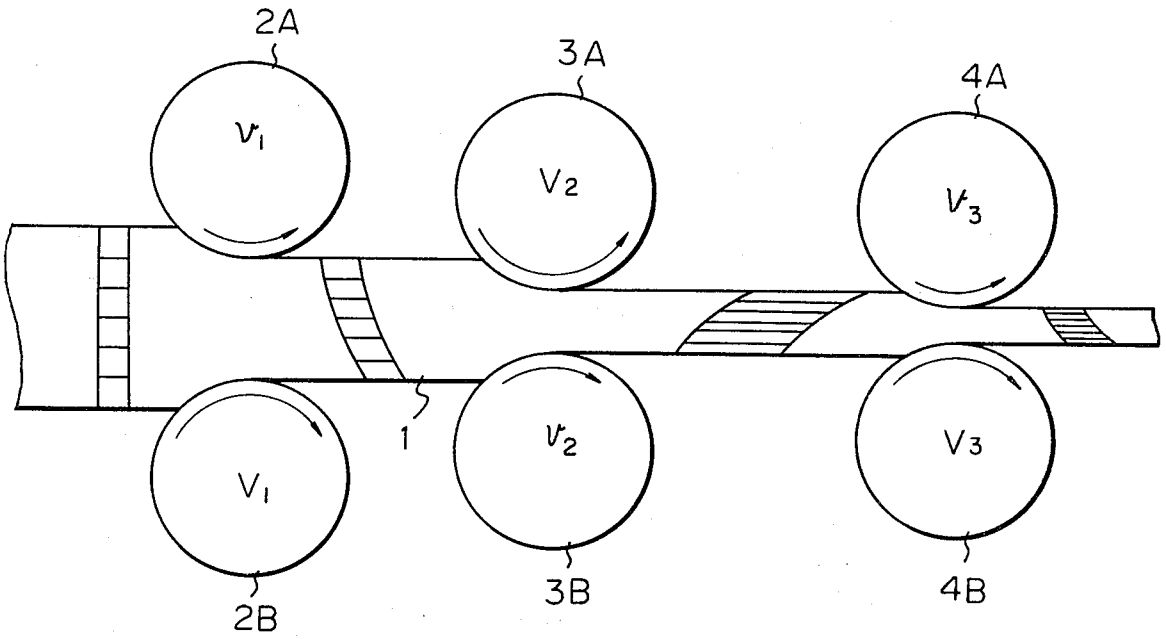
FIG. 1 is a schematic drawing illustrating the hot rolling methods with unequal circumferential speed rolls according to the present invention.

Referring to FIG. 1, the work piece 1, for example, a continuously cast slab heated to a temperature higher than 1300° C., is subjected to three rolling passes. The first pair of rolls consist of an upper work roll 2A having a low circumferential speed ($v_1$) and a lower work roll 2B having a high circumferential speed ($V_1$). The second pair of rolls consist of an upper work roll 3A having a high circumferential speed ($V_2$) and a lower work roll 3B having a low circumferential speed ($v_2$). The third pair of rolls consists of an upper work roll 4A having a low circumferential speed ($v_3$) and a lower work roll 4B having a high circumferential speed ($V_3$). Therefore, each of the upper surface and the lower surface of the work piece 1 is, alternately rolled by the low and high circumferential speed rolls. A shear strain is generated in the work piece by the first rolling pass with the unequal circumferential speed rolls, and the second rolling pass induces a shear strain in a direction different from that in the first pair of rolls. The application of the shear strain by the process of the present invention is considerably effective for breaking up the elongated coarse grains having a <110> orientation in the rolling direction, as compared to the process in which each side of the work piece undergoes the rolling by other either the high or the low circumferential speed rolls. In addition, the strength of the (110) plane is enhanced. As a result of the breaking up of the elongated coarse grains having the <110> orientation and the enhancement of the strength of the (110) grains, the magnetic properties are enhanced.

The ratio of the unequal roll-circumferential speed can be defined by:

$$V_R = \left(\frac{v_i}{V_i} - 1\right) \times 100\%,$$

wherein the $v_i$ and $V_i$ are the lower and higher circumferential speeds of a given pair (i) of the work-rolls, respectively.

The ratio ($V_R$) mentioned above is preferably at least 5%. The maximum ratio ($V_R$) is not specifically limited but is preferably about 35% in the light of the capacity of a modern hot rolling mill. The ratio ($V_R$) at each of the rolling passes or mills may be the same as or different from each other. Although two rolling passes, wherein the rolls with the unequal circumferential speeds are arranged, are necessary and sufficient for effectively breaking up the elongated coarse grains, three or more rolling passes, in which the high and low circumferential speed work-rolls are arranged, are desirable for more effectively breaking the coarse and elongated grains.

The present invention is explained in detail hereinafter.

The starting material of the process according to the present invention contains from up to 4.0% by weight of silicon and not more than 0.085% of carbon, as well as an appropriate amount of commonly known components as inhibitors, such as aluminum, nitrogen, manganese, sulfur, selenium, and antimony. The remainder of the starting material is iron and unavoidable impurities. When the silicon content exceeds 4.0%, the cold rolling becomes disadvantageously difficult. The silicon content is preferably 2.0% or more, because with a silicon content of less than 2.0%, such disadvantages as the deterioration of magnetic properties, particularly the watt loss, are caused by the low silicon content. It is well known in the art of grain-oriented silicon steel that the watt loss can be reduced by the increase of the silicon content. However, the secondary recrystallization becomes incomplete with the increase in the silicon content and, hence, the final products of the required magnetic properties, cannot be obtained only by the increase in the silicon content. In the steel strip containing 3% by weight or higher, preferably 3.5% by weight or higher of silicon, the secondary recrystallized grains can be completed due to the introduction in the hot rolling step of an asymmetric plastic flow. It is, therefore, possible to provide the grain-oriented silicon steel strip with a low watt loss which is decreased with the increases of silicon content up to 4.0%. When the carbon content exceeds 0.085%, it becomes difficult to reduce the carbon level in the decarburization annealing, which is undesirable. The carbon is required for preventing the grain growth during heating and is also required for promoting the breaking up of the coarse grains during the hot rolling. It has been conventionally preferred to contain approximately 0.06% of carbon in the steel at the time of steelmaking. If the carbon content is less than approximately 0.06%, streaks are likely to form in the final products produced by the conventional process.

In the process of the present invention, the slab is subjected to hot rolling passes with unequal circumferential speed rolls, and a plastic flow, which is asymmetric in the upper and lower regions of the steel slab, as seen in the cross section of the steel slab in the rolling direction, is generated at each hot rolling pass. An important point in the present invention is that the asymmetric plastic flow of at least two hot rolling passes is induced in directions intersecting to each other substantially perpendicularly. Such a plastic flow is hereinafter referred to as the asymmetric intersecting plastic flow. Due to the asymmetric intersecting plastic flow, the carbon content can be reduced from 0.06%, the amount which is necessary in the conventional process for preventing streaks, to approximately 0.04%. The low carbon content facilitates the decarburization annealing and is advantageous from the industrial point of view because of the low heat energy necessary decarburization. In addition to the reduction of the carbon content and the increase of the silicon content without forming streaks, components of the inhibitors, particularly aluminum, can be increased due to the asymmetric intersecting plastic flow. From the starting material of the process according to the present invention, it should be understood that the steel material containing the components mentioned above is prepared by known techniques of steelmaking, melting and the forming of castings or steel sections, particularly continuous casting. The continuous cast strand can be advantageously hot rolled by the process of the present invention, while the elongated coarse grains, which cause the formation of streaks in the final product, are effectively broken up due to the asymmetric intersecting plastic flow.

The starting material described above is heated to a temperature of 1300° C. or higher and, subsequently, hot-rolled into a hot rolled strip. The hot rolled strip is subjected, if necessary, to annealing at a temperature of 1200° C. or lower for a period of 30 minutes or shorter and, then, cold rolled to the final thickness. The cold rolling is carried out at least one time and may be followed by annealing. The combination of the annealing step and the cold rolling step is conventionally carried out in the process for producing a grain oriented silicon steel strip. The steel strip having the final thickness is subjected to decarburization annealing followed by the final high temperature annealing. The condition of annealing between the rolling steps is known from U.S. Pat. No. 3,636,579, issued to Sakakura et al and assigned to Nippon Steel Corporation. The condition of decarburization annealing and final high temperature annealing is known from U.S. Pat. No. 3,990,923, issued to Takanaski et al and assigned to Nippon Steel Corporation. The crux of the present invention resides in the slab-hot rolling process which generates the asymmetric intersecting plastic flow in a slab. The slab is heated to a high temperature of above 1300° C. in a slab-heating furnace and, then, is taken out of the furnace. The slab is then hot rolled into a sheet-bar having a predetermined thickness in a rough rolling step having a plurality of passes, and the sheet-bar is rolled into a hot rolled steel strip having a predetermined thickness in a finish rolling step with a plurality of passes.

Figure 2:
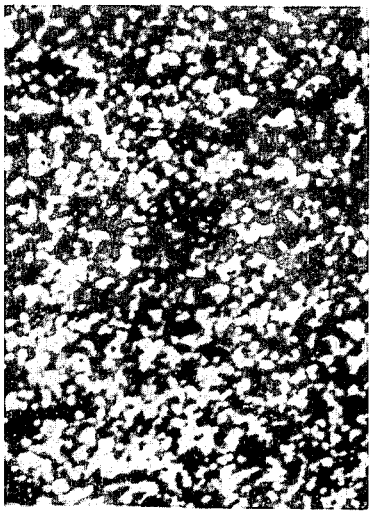
FIGS. 2 through 4 illustrate the relationship between the hot rolling temperature with the unequal circumferential speed rolls and the secondarily recrystallized structure.
Figure 3:
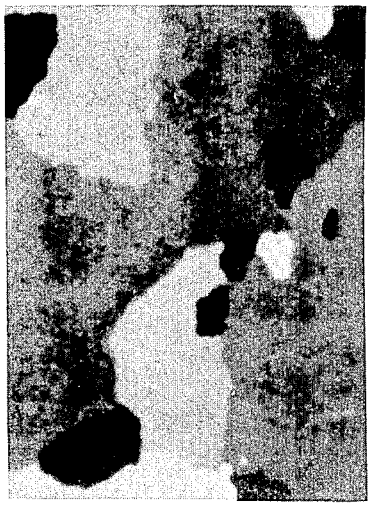
Figure 4:
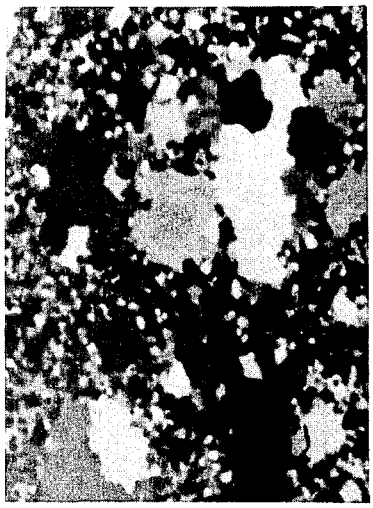

The rough rolling is usually carried out at a temperature higher than 1200° C. and the finish rolling is usually carried out at a temperature in the range of from 950° to 1250° C. The hot rolled strip produced by a hot rolling process, in which asymmetric intersecting plastic flow is generated, does not exhibit broken-up coarse grains remaining at a core of the strip and elongated in the rolling direction. The texture of this core consists of crystal grains exhibiting a sharp orientation of from {001}<110>~{112}<110>. The texture mentioned above is stable in the cold rolling and annealing subsequent to the hot rolling, and remains as streaks in the final product. As a result, the secondary recrystallization may be realized incompletely. Such incomplete secondary recrystallization leads to poor magnetic properties. In order to break up the texture mentioned and to simultaneously develop the complete secondary recrystallization and to provide the grain-oriented electromagnetic steel strip or sheet with a very low watt loss level, particularly from 1.02 to 1.03 W/kg, it is necessary to: heat the slab to a temperature of 1300° C. or higher; subject the so heated slab to at least two hot rolling passes with unequal roll circumferential speeds; and, adjust the rolling temperature of the steel with the unequal roll circumferential speeds to a temperature of from 1250° to 950° C. If the heating temperature of the slab is lower than 1300° C., for example about 850° C. and the rolling temperature of the steel with the unequal roll circumferential speeds is from 850° to 800° C., the microstructure of the silicon steel is as shown in FIG. 2 and the secondary recrystallized grains do not develop at all. If the heating temperature of the slab is higher than 1300° C. but if the rolling temperature of the steel with the unequal roll circumferential speeds is lower than 950° C., for example, from about 850° to 800° C., the microstructure of the silicon steel is as shown in FIG. 4 and the secondary recrystallized steel does not develop appreciably. FIG. 3 shows the microstructure of silicon steel processed according to the present invention and the completely developed secondary recrystallized grains.

Due to the breaking up of the elongated coarse grains, in addition to the elimination of the streaks, the number of crystal nuclei of Goss orientation, i.e. {110}<001> orientation, is increased and, therefore, the magnetic properties of the final products are enhanced.

Conventionally, a hot finish rolling is carried out by a five or six stand rolling mill. At least two stands, which are not restricted to the combination of neighbouring stands, but may be any combination of at least two stands, must have the work-rolls with the unequal roll-circumferential speeds mentioned above. A roll stand with equal roll-circumferential speeds may be positioned between at least two stands mentioned above. Further, the high and low circumferential speed work-rolls of each roll pair may be successively arranged along the rolling direction, in such a manner that the position of either of these rolls relative to the work piece alternates along the rolling direction.

The hot rolling with an asymmetric intersecting plastic flow is preferably carried out at the finish rolling step, but may be carried out at the rought rolling step. In order to achieve the hot rolling with the asymmetric intersecting plastic flow, the ratio of the diameters of the upper and lower work rolls can be chosen so that they are greater or smaller than 1.00.

The present invention will now be more fully explained by way of example.

EXAMPLE

A 200 mm thick continuously cast slab containing 0.05% by weight of carbon, 3.0% by weight of silicon, and 0.03% by weight of aluminum was heated to 1400°

C. and then hot rolled into a 2.3 mm thick strip after the roght rolling by a six-stand finish rolling mill under the following conditions.

| | | |
|---|---|---|
| A. | Condition 1: (Comparative Example) | The upper work rolls of the fourth and fifth stands of the finish rolling mill were the high circumferential speed rolls having the ratio ($V_R$) of the unequal circumferential speeds of 10%. |
| B. | Condition 2: (Comparative Example) | The lower work rolls of the fourth and fifth stands were the high circumferential speed rolls having the ratio ($V_R$) of the unequal circumferential speeds of 10%. |
| C. | Condition 3: (Invention) | The upper work roll of the fourth stand and the lower roll of the fifth stand were the high circumferential speed rolls, and the ratios ($V_R$) of the unequal circumferential speed of these rolls were 10%. |
| D. | Condition 4: (Invention) | The lower work roll of the fourth stand and the upper work roll of the fifth stand are the high circumferential speed rolls, and the ratios ($V_R$) of the unequal circumferential speeds of these rolls are 10%. |

Figure 5:
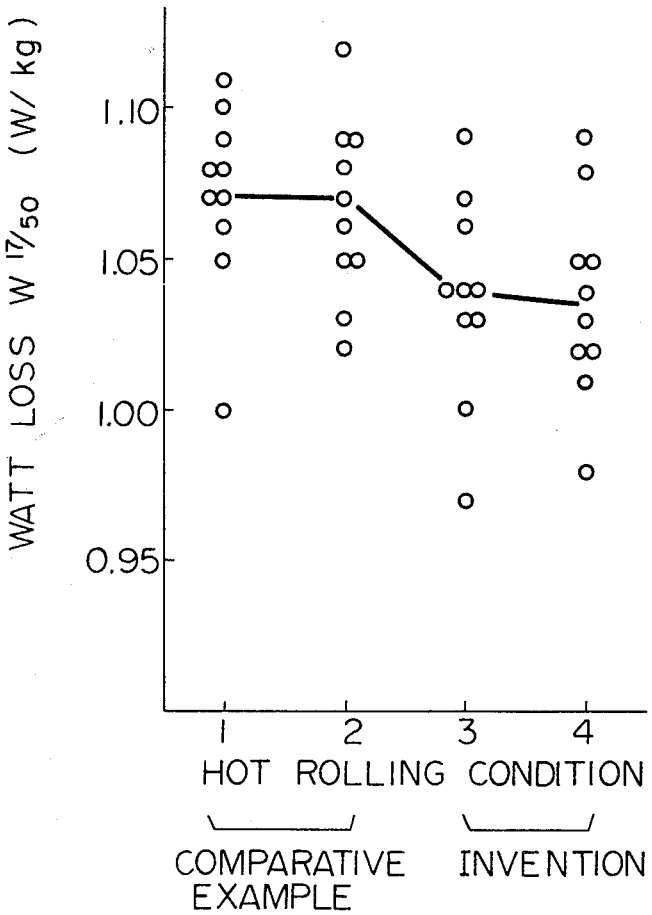
FIG. 5 is a graph indicating the watt loss values obtained by the two hot rolling methods with unequal roll-surface speed.

The resultant hot rolled strips were, annealed cold-rolled, decarburization-annealed and recrystallization-annealed by a conventional manner, so that grain-oriented electromagnetic steel strips were produced. The watt loss ($W_{17/50}$) of the grain-oriented electromagnetic steel strips was measured. The measured results are given in Table 5. It will be apparent from FIG. 5 that the watt loss values obtained by the hot rolling condition according to the present invention are superior to those obtained by the comparative hot rolling condition.

We claim:

1. A process for producing a grain-oriented electromagnetic steel strip or sheet product from a slab of continuously cast steel, comprising hot rolling said slab into a hot-rolled strip by passage through a plurality of roll stands wherein at least two of the roll stands have a rolling temperature within the range of from 1250° to 950° C. and each of said two roll stands has upper and lower working rolls which relative to each other are circumferentially high-speed and low-speed rolls and the upper roll of one roll stand is a high-speed roll and the upper roll of the other of the said two roll stands is a low-speed roll, cold rolling said hot-rolled strip into a cold-rolled strip and recrystallization annealing the cold-rolled strip so as to produce said product.

2. A process according to claim 1 characterized in that said steel slab contains at least one inhibitor component effective in the inhibition of grain growth.

3. A process as recited in claim 1 or 2 characterized in that said continuously cast slab is heated to a temperature of not lower than 1300° C. and then hot rolled.

4. A process according to claim 3 wherein the ratio of the unequal roll-circumferential speeds defined by:

$$V_R = \left(\frac{V_i}{v_i} - 1\right) \times 100\%,$$

wherein the $v_i$ and $V_i$ are the low and high circumferential speeds of the rollers of a given roll stand (i), is at least 5%.

* * * * *